United States Patent [19]

Pentith

[11] 4,155,597

[45] * May 22, 1979

[54] MINERAL WINNING/DETACHING MACHINES

[75] Inventor: Gerald R. O. Pentith, Barnsley, England

[73] Assignee: Pitcraft Limited, Sheffield, England

[ * ] Notice: The portion of the term of this patent subsequent to Jan. 10, 1995, has been disclaimed.

[21] Appl. No.: 780,069

[22] Filed: Mar. 22, 1977

Related U.S. Application Data

[63] Continuation-in-part of Ser. No. 574,948, May 6, 1975, Pat. No. 4,067,257.

[51] Int. Cl.[2] ..... E21C 35/04

[52] U.S. Cl. ..... 299/42; 299/12

[58] Field of Search ..... 299/42, 43, 12; 191/30, 191/35, 57, 59.1; 104/194

[56] References Cited

U.S. PATENT DOCUMENTS

| | | | |
|---|---|---|---|
| 3,649,779 | 3/1972 | Howell, Jr. | 191/59.1 |
| 3,784,256 | 1/1974 | Katlic | 299/12 |
| 3,821,497 | 6/1974 | Laurent | 191/57 |
| 3,848,712 | 11/1974 | Flodell | 191/59.1 |
| 4,025,118 | 5/1977 | Lantermann et al. | 104/194 |

*Primary Examiner*—William Pate, III

*Attorney, Agent, or Firm*—Lowe, King, Price & Becker

[57] ABSTRACT

A self-propelled mineral winning/detaching machine incorporating at least one electric motor and provided with electrical pick up means movable, in use, with said machine to pick up electrical energy from a stationary conductor.

8 Claims, 5 Drawing Figures

23
12
16
28
29
30
30
31
15
25
26
14
27
17
27
15
13
27
27
32
35
13
18
19
21
22

23
12
29
28
36
V
15
16
30
17
36
26
14
13
27
27
38
37
27
16
V

MINERAL WINNING/DETACHING MACHINES

This application is a continuation-in-part of Ser. No. 574,948 filed May 6, 1975, now U.S. Pat. No. 4,067,257.

This invention relates to mineral winning/detaching machines, particularly though not exclusively for coal mining.

A well-known type of longwall mining machine used extensively in the European coalfields is adapted to run along and/or be guided by an armoured, flexible scraper chain conveyor extending along the mineral face. Such a machine requires power for two purposes, firstly to haul itself along the mineral face and secondly, to drive mineral cutting means, e.g. cutting heads and/or chains.

For hauling itself along the mineral face, the machine has in the past been provided with an electric motor and associated sprocket(s) for engaging a tensioned haulage chain staked at each end of the mineral face, while the mineral cutting means have been driven usually by electric but sometimes by hydraulic motors. More recently alternative haulage systems obviating the need for a haulage chain have been proposed and that of U.S. Pat. No. 3,753,596 is in use in British coal mines, and in the system of U.S. Pat. No. 3,753,596 the machine drives itself from the conveyor.

However, whilst the above such haulage proposals have obviated the need for the haulage chain, the use of electric motors necessitates electric supply cables extending along the mineral face, which cables are attached to the machine and hence displayed by the machine as the latter hauls itself to and fro along the mineral face, and a common problem is the handling of these necessarily flexible cables, which are usually contained in a pocket or channel extending along the goaf side of the conveyor, the main requirements being firstly to keep the cables off the conveyor and secondly out of the path of the conventional, hydraulically powered, self-advancing mine roof supports extending along the goaf side of the conveyor. Apart from the longwall type of mining machine described above, there are similar machines which operate on "shortwalls" e.g. of 30 yd length compared with say a 200 yd length of longwall face. Also extensively used in the U.S. coalfield as "continuous miners" which are machines, usually crawler mounted on endless tracks, having plurality of forwardly located pick-carrying drums and/or chains, as well as machines for driving tunnels, or mine roadways. However, all these self-propelled machines require flexible cables to convey electric power to one or more electric motors of the machines.

Thus, whatever particular self-propelled mineral winning/detaching equipment is involved, relatively long, trailing, electrical supply cables are employed, which inter alia fatigue at their bending points, and which inevitably become caught or damaged by the equipment involved.

The object of the present invention is to provide a mineral winning/detaching machine that obviates the need for the usual electrical supply cables attached to a machine and that provides a more efficient means of power supply to a machine.

According to a first aspect of the present invention, there is provided a self-propelled mineral winning/detaching machine incorporating at least one electric motor and provided with electrical pick up means movable, in use, with said machine to pick up electrical energy from a stationary conductor.

The pick-up means may comprise one or more current collector shoes but alternatively could be an induction coil of generally conventional configuration with the usual current collector(s).

The machine preferably also includes a double-ended entry wedge to gain access to the electrical conductor.

According to a second aspect of the present invention, there is provided a self-propelled longwall mining machine incorporating at least one electric motor and provided with electrical pick up means movable, in use, with said machine along an armoured face conveyor to pick up electrical energy from a conductor carried by or forming part of said conveyor.

Again the pick-up means may comprise one or more pantographs, but alternatively could be an induction coil of generally conventional configuration with the usual current collector(s), while the machine preferably also includes a double ended entry wedge.

The stationary conductor is preferably a conduit as described in co-pending application Ser. No. 574,948.

For a longwall mining machine the conduit may be attached to support plates located on the goaf side of conveyor pans, the conduit being fabricated to rectangular section. For a shortwall mining machine, a continuous miner, or a tunnelling machine or a roadway driving machine, the conduit may be mounted at roof or floor level or intermediate the roof and floor. Thus it may be attached to the conventional roof supports or to the conventional roadway arches.

According to another preferred feature, the pick up means from the electrical machine e.g. the current collect shoe is located at the end of a relatively long arm e.g. 10 to 15 ft. which passes through the sealing means to enter the conduit, to ensure that any sparking that takes place at the current collect shoe is positively contained within the conduit at the zone surrounding the shoe and cannot escape through the sealing means displaced by the shoe carrying arm.

Preferably two current collector shoes are employed such that whenever one shoe spans a joint between adjacent conductors and hence may be subject to ineffective or intermittent current pick up, the other is not over a joint, so as to ensure satisfactory and constant current pick up.

The invention will now be further described, in greater detail, by way of example, with reference to the accompanying drawings, in which.

Figure 3:
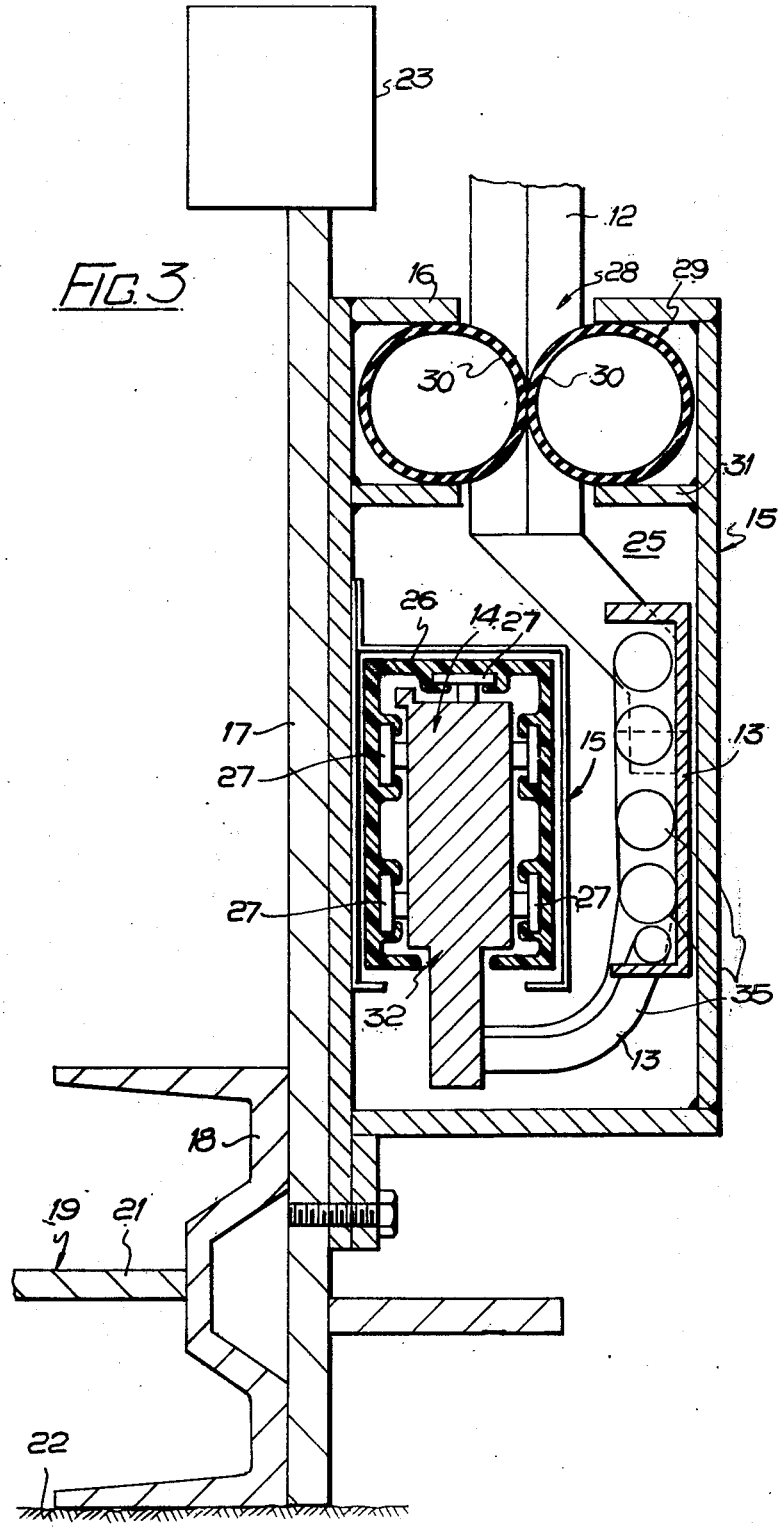
FIG. 3 is a section on the line III to III of FIG. 2.
Figure 4:
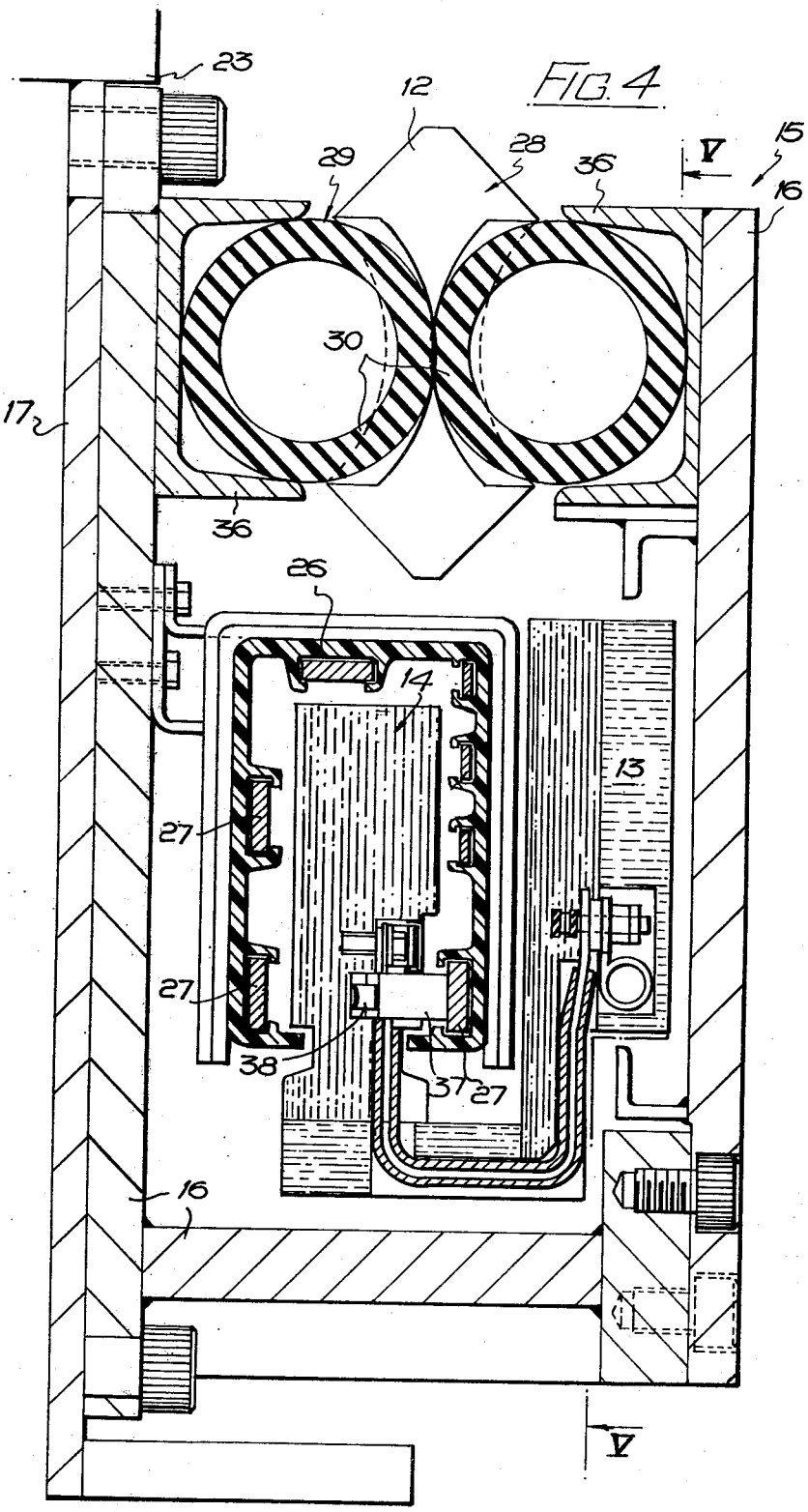
Figure 5:
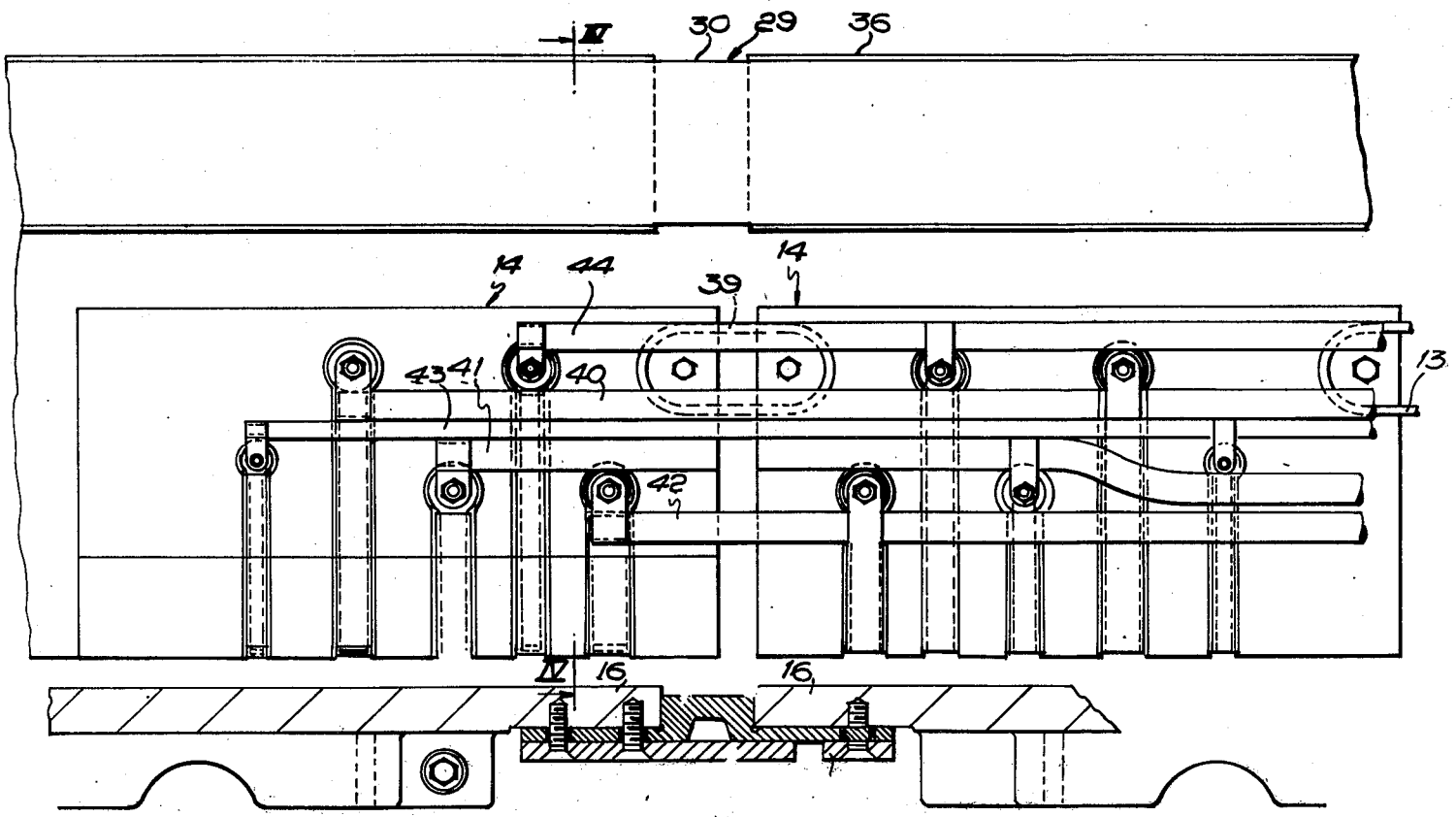

FIG. 4 corresponds to FIG. 3, but is a sectional view through a second embodiment of conduit in accordance with the invention, being generally on the line IV to IV of FIG. 5; and FIG. 5 is a view generally on the line V to V of FIG. 4.

In all Figures like component parts are accorded like reference numerals.

Figure 1:
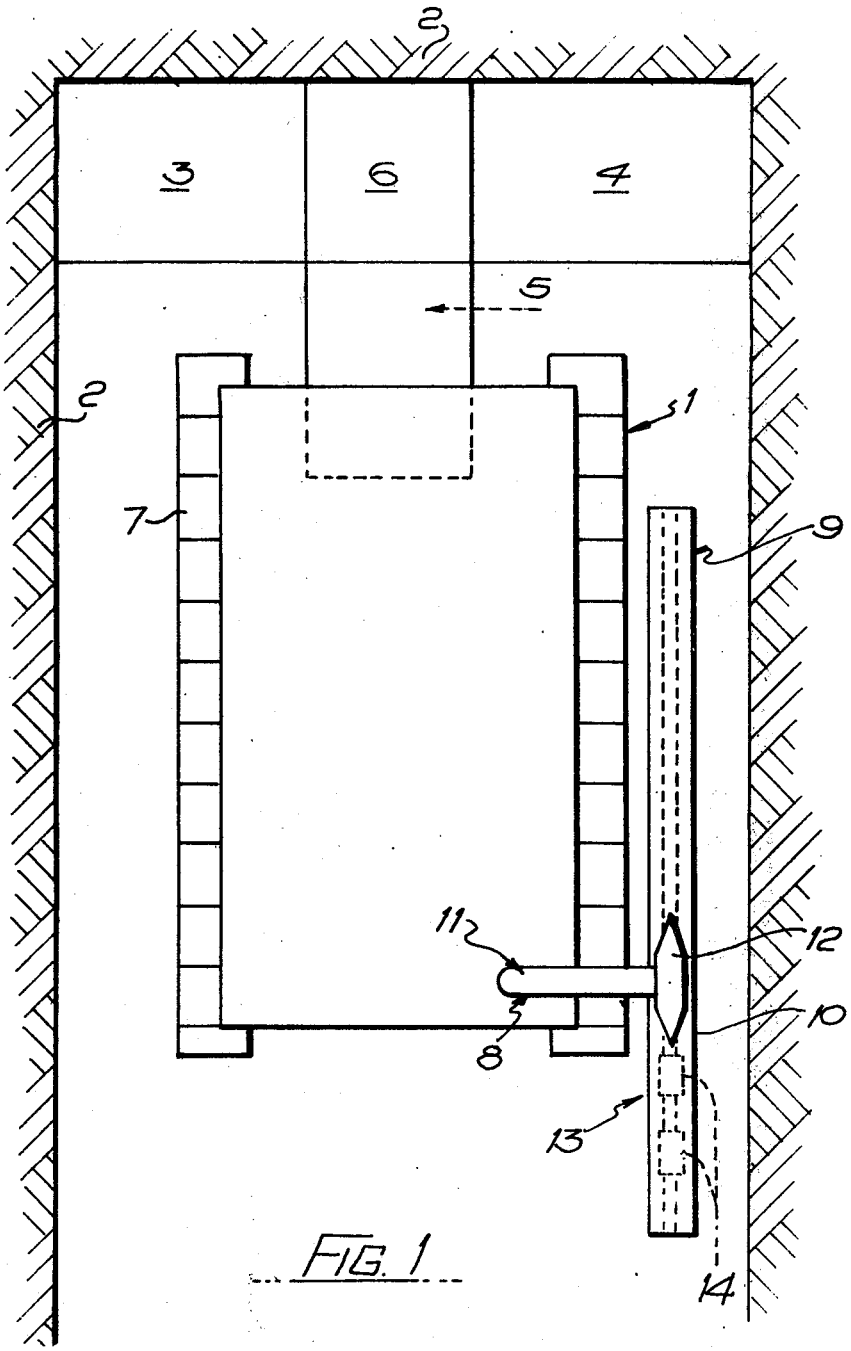
FIG. 1 is a diagrammatic plan view of a continuous miner in accordance with the invention.

In the embodiment of FIG. 1, a continuous miner 1 is operating in a mineral seam 2 and is provided with forwardly located drums 3, 4 provided with picks (not shown) and spaced apart by a support arm 5 containing a gear drive to the drums and covered with a pick carrying chain 6. Usually the support arm 5 is articulated with reference to the miner 1 so that the drums 3 and 4 may accurately follow the mineral seam 2 and/or may be adjusted to follow seam thickness variations. The miner 1 is mounted on crawler tracks 7 and conveyor means to remove won mineral is not shown. The miner 1 is provided with an electrical pick up means 8 entering a normally closed and sealed stationary conduit 9 housing at least one conductor 10. The pick up means 7 comprises a first arm 11 extending latterally from the miner 1, an entry wedge 12 and a second arm 13 terminating in two spaced pantographs 14. The conduit 9 is lengthened as the miner 1 advances by adding sections as required, and the conduit preferably used is described in greater detail in co-pending U.S. application Ser. No. 574,948.

Figure 2:
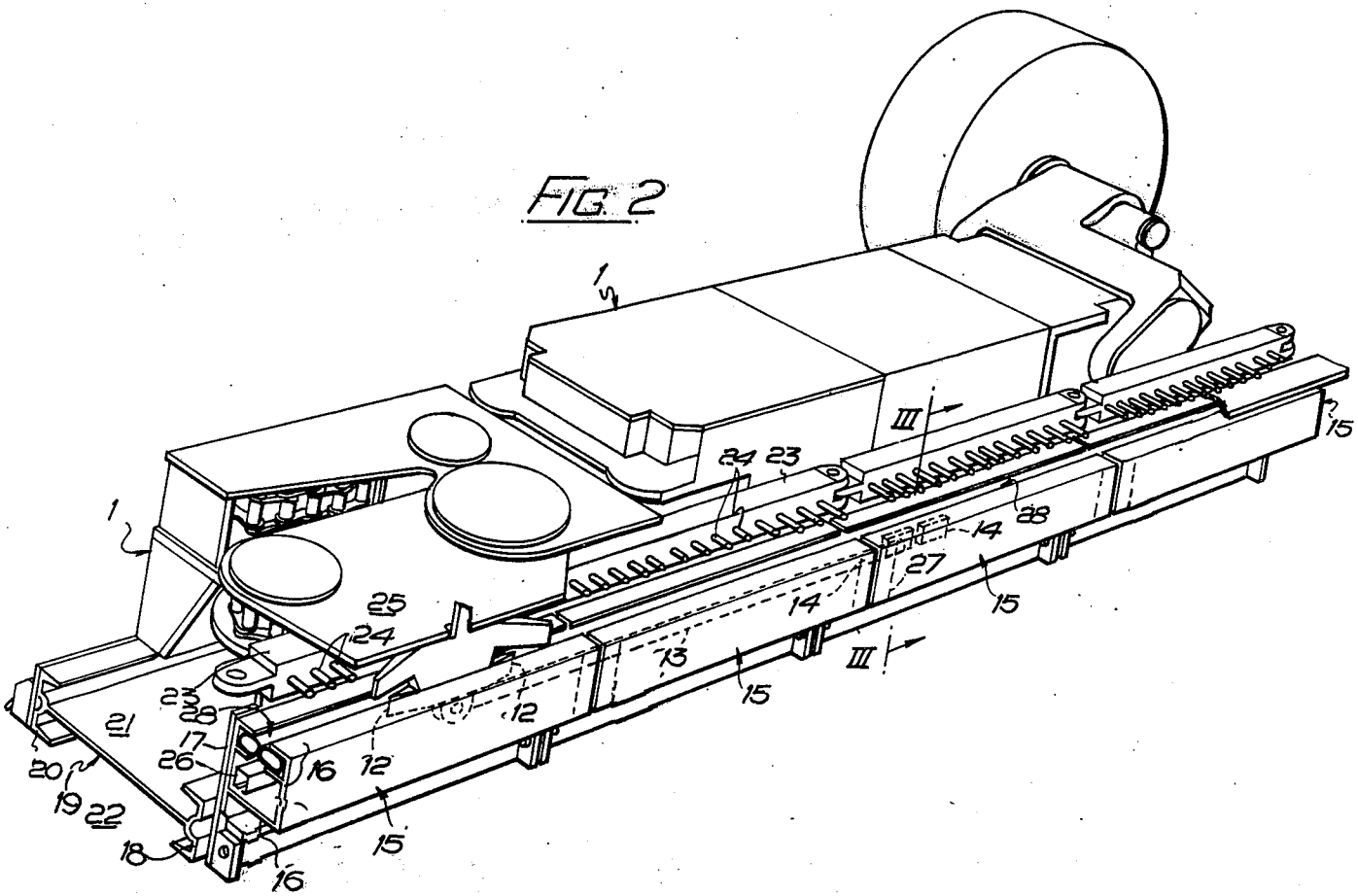
FIG. 2 is a perspective view of a longwall/shortwall mining machine in accordance with the invention mounted on an armoured conveyor.

In the embodiment of FIG. 2 a hollow rectangular conduit 15 fabricated from top, bottom and side plates 16 is bolted to a support plate 17 attached to a goaf sidewall 18 of a conveyor pan 19 having a face side sidewall 20 spaced from sidewall 18 by a deck plate 21. A plurality of pans 19 are connected together, end to end to form an armoured conveyor extending along the mineral face (not shown). The conveyor is seated on a mine floor 22 while the mining machine 1, indicated as a conventional longwall/shortwall machine is located on, and guided by the conveyor sidewalls via the conventional shoes. At the upper end of the plate 17 of each pan is supported one or more rack bars 23 housing reciprocable pegs 24 for the mining machine 1, having a haulage arrangement 25 of the form described in U.S. Pat. No. 3,753,596.

As shown in FIGS. 2 and 3, the conduit 15 is provided with an insulated, extruded, synthetic plastics carrying rail 26 for a plurality of elongate copper conductors 27 while the conduit of each pan is also provided with a longitudinally extending entry slot 28 in the top plate 16 closed by a flexible sealing means 29 constituted by a pair of inflated tubes 30, adjacent peripheries thereof abutting one another, each tube 30 being located between a top plate 16 and an intermediate plate 31. A pick up means 32 enters the slot 28 and is constituted by two spaced current collector shoes 14, incorporating suitable brush gear, extending from the machine, which current collector shoes move with the machine, along the individual pans 19. The current collector shoes 14 are located at one end of a towing link constituted by the arm 13 that extends longitudinally within the conduit 15 and extends from a double ended, P.T.F.E. coated or chromium plated, entry wedge or divider 12 to part the tubes 30 so that when the sealing means 29 is progressively displaced by the wedge 12, as the machine 1 advances, the shoe 14 are remote from the displaced sealing means 29 by a distance corresponding to the length of the arm 13 and as illustrated in FIG. 1, by at least the length of one conveyor pan 19. With the arm 13 extend the necessary cables 35 conveying power from the conductors 27 to the conventional electric motor of the machine 1. In accordance with a preferred proposal, the interior of the conduit 15 is filled with fresh clean air at a pressure higher than the ambient air pressure so that in the case of coal mining for instance, methane cannot enter the conduit, to provide a flameproof source of electrical power for a machine. Furthermore, by providing sufficient cross-sectional area of conductors 27, several machines e.g. three, can operate on the same conveyor, while power for the other sources e.g. coal face signalling systems, powering motors for conveyor drives etc., can be taken from the conduit 15 thereby eliminating the need for conventional electrical cables.

In the embodiment of FIGS. 4 and 5 the top and intermediate plate are provided by the flanges of angle irons 36, while one current collecting brush 37 of one shoe 14 is shown urged into contact with its conductor 27 by a leaf spring 38. As illustrated in FIG. 5, the two current collector shoes 14 are connected by a link 39 and a 3-phase current supply to the electric motor of the machine 1 is converted by leads 40, 41 and 42, while there is also provided a pilot lead 43 and an earth lead 44.

What I claim is:

1. A self-propelled mineral winning/detaching machine having at least one drive electric motor; a stationary, electric conductor positioned in proximity to said machine and carrying electrical current to be supplied to the at least one drive motor; electrical pick-up means carried by said machine, said pick-up means extending into electrical contact with said stationary electric conductor and slidable therealong during movement of said machine to maintain electrical contact between said pick-up means and said conductor; and a hollow conduit containing said stationary conductor, said conduit having a slot through which said pick-up means extends to contact said conductor, said conductor being pressurized above an ambient pressure to prevent ingress of outside gases.

2. A mineral winning/detaching machine as claimed in claim 1, wherein said pick up means comprises at least one current collector shoe.

3. A mineral winning/detaching machine as claimed in claim 1, comprising a double ended entry wedge.

4. A mineral winning/detaching machine as claimed in claim 1, wherein the pick up means is located at the end of a relatively long arm.

5. A self-propelled longwall mining machine having at least one drive electric motor; an armoured face conveyor; a stationary electric conductor carried by or forming a part of said conveyor and carrying electric current to be supplied to the at least one drive motor; electrical pick-up means carried by said machine and extending into electrical contact with said electricl conductor and slidable therealong to maintain electrical contact between said pick-up means and said conductor; and a hollow conduit containing said stationary conductor, said conduit having a slot through which said pick-up means extends to contact said conductor; said conduit being pressurized above an ambient pressure to prevent ingress of outside gases.

6. A mineral winning/detaching maching as claimed in claim 5, wherein said pick up means comprises at least one current collector shoe.

7. A mineral winning/detaching machine as claimed in claim 5, comprising a double ended entry wedge.

8. A mineral winning/detaching machine as claimed in claim 5, wherein the pick up means is located at the end of a relatively long arm.

* * * * *